US006398828B1

(12) United States Patent
Dannöhl

(10) Patent No.: US 6,398,828 B1
(45) Date of Patent: Jun. 4, 2002

(54) SECONDARY PISTON COMPRESSOR

(75) Inventor: Peter F. Dannöhl, Oberhausen (DE)

(73) Assignee: Druckluft Dannöhl GmbH (DE)

( * ) Notice: Subject to any disclaimer, the term of this patent is extended or adjusted under 35 U.S.C. 154(b) by 0 days.

(21) Appl. No.: 09/545,972

(22) Filed: Apr. 10, 2000

(30) Foreign Application Priority Data

Apr. 10, 1999 (DE) ..... 199 16 172

(51) Int. Cl.[7] ..... B01D 50/00; F04B 39/04

(52) U.S. Cl. ..... 55/315; 55/385.3; 55/423; 55/DIG. 19

(58) Field of Search ..... 96/108, 189; 55/315, 55/385.3, 420, 482, DIG. 19; 123/573

(56) References Cited

U.S. PATENT DOCUMENTS 3,630,182 A * 12/1971 Grainger
3,721,069 A * 3/1973 Walker ..... 55/337
4,136,650 A * 1/1979 Manookian, Jr.
4,269,607 A * 5/1981 Walker ..... 55/330
5,113,836 A * 5/1992 Sweeten ..... 123/573
5,479,907 A * 1/1996 Walker, Jr. ..... 123/573
5,586,996 A * 12/1996 Manookian, Jr. ..... 55/321
5,669,366 A * 9/1997 Beach et al. ..... 123/572
5,837,018 A * 11/1998 Goerg ..... 55/385.3
6,171,355 B1 * 1/2001 Gieseke et al. ..... 55/330

* cited by examiner

*Primary Examiner*—David A. Simmons
*Assistant Examiner*—Frank M. Lawrence
(74) *Attorney, Agent, or Firm*—Blakely Sokoloff Taylor & Zafman

(57) ABSTRACT

A secondary piston compressor has a crankcase, which is provided with a venting device. The latter includes an oil filter, which is constructed in the form of a superfine filter and is arranged in a separate housing. The superfine filter is in communication on the inlet side with an oil filler pipe of the crankcase via a conduit. It is connected on the outlet side to the atmosphere via an active carbon filter. On the inlet side, the superfine filter defines an oil collecting space, which is connected via a conduit to the crankcase with the interposition of a non-return valve. The non-return valve is held in its closed position by the pressure in the crankcase. When the secondary compressor is switched off, it opens and empties the oil collecting space of the superfine filter into the crankcase.

8 Claims, 1 Drawing Sheet

SECONDARY PISTON COMPRESSOR

FIELD OF THE INVENTION

The invention relates to a secondary piston compressor including a crankcase, which is provided with a venting device, the venting device having an oil filter, which is connected on the inlet side to the crankcase and on the outlet side to the atmosphere. Such a secondary compressor is used for increasing the pressure of air or other environmentally compatible gases.

DESCRIPTION OF THE PRIOR ART

As a result of leakage losses, a pressure builds up in the crankcase, which makes it necessary to vent the crankcase. With normal compressors, whose suction side is at atmospheric pressure, the vented gas-oil mist can be fed to the suction side of the compressor. This is not possible with secondary compressors since they operate with an inlet pressure. The vented gas-oil mist must thus be fed through the oil filter in this case and then discharged into the atmosphere. It has transpired that the oil filters, which are wire mesh filters, are only of limited efficiency. The consequence is that oil gets into the atmosphere. This represents a burden on the environment and results also in excessive oil consumption.

It is therefore the object of the invention to prevent the undesired discharge of oil when venting the crankcase or at least drastically to reduce it.

SUMMARY OF THE INVENTION

In order to solve this object the secondary compressor of the type referred to above is characterised in accordance with the invention that the oil filter is constructed in the form of a superfine filter and has an oil collecting space on the inlet side with an oil outlet, the oil outlet communicating with the crankcase.

The invention is based on the recognition that only very little space is available for the wire mesh filter in the low turbulence, that is to say upper, region of the crankcase. The small flow area caused thereby permits only a small pressure loss if the venting is to operate effectively and reliably. The small permissible pressure loss results in turn in a correspondingly large mesh wire mesh filter. This is the explanation for the high permeability to relatively small and even relatively large oil droplets.

The superfine filter used in accordance with the invention, on the other hand, which generally comprises a microfibre fleece, can reliably retain the oil components of the mist. The residual oil content can be reduced to less than 0.01 mg/$M^3$. However, the superfine filter requires a correspondingly larger area which is made available by the oil collecting space.

If the superfine filter is integrated into the crankcase, the wall of the oil collecting space constitutes an effective shield against the direct impingement of oil on the superfine filter. The area of the superfine filter can thus also extend into regions of the crankcase which can no longer be referred to as of low turbulence. The oil dripping down from the superfine filter can discharge continuously or intermittently out of the oil collecting space into the crankcase via its oil outlet. If a permanently opened passage is provided, this is kept so small that direct impingement of oil on the superfine filter does not occur.

In an important embodiment of the invention, it is proposed that the superfine filter be arranged in a separate housing connected to the crankcase by means of conduits, the conduit connecting the oil collecting space to the crankcase including a valve, which adopts its closed position, when the secondary compressor is operating, and its open position, when the secondary compressor is not operating.

The superfine filter is thus separated from the crankcase in this construction and is not subject to any sort of restriction as regards the fineness of its pores and the size of the filter surface. These parameters may be adjusted to an optimum separation of oil droplets and vapours whilst taking account of the permissible pressure loss. When the secondary compressor is running, the oil outlet of the oil collecting space is closed so that the oil collecting space communicates with the crankcase only via its inlet conduit, that is to say the actual venting conduit, and pressure also acts on it only via this conduit. The emptying of the oil collecting space is effected when the secondary compressor is not operating.

The valve is preferably arranged in an inclined section of the associated conduit and constructed in the form of a non-return valve, whereby it is maintained in its closed position by the pressure in the crankcase. The superfine filter thus operates automatically. The non-return valve is a very easily movable valve, whose valve member is lifted and moved into the closed position by the gentle flow during start-up of the secondary compressor. Opening occurs under the action of the weight of the valve body and the weight of the oil column above it. It is generally advantageous to associate a light valve spring with the non-return valve which promotes the movement of the valve body into the closed position.

It is of importance that the conduit leading from the oil outlet of the superfine filter to the crankcase has an inclined section for the non-return valve. Particularly advantageous conditions are produced if the superfine filter is disposed directly above the crankcase.

In order to maintain the oil loading of the superfine filter as low as possible, it is proposed that the conduit connecting the housing of the superfine filter on the inlet side to the crankcase is connected to a low turbulence region of the crankcase, preferably to an oil filler pipe, which ensures optimal shielding.

A safety valve, which is connected to the conduit connecting the housing of the superfine filter on the inlet side to the crankcase, reliably prevents the build-up of an overpressure in the crankcase, if trouble should occur in the region of the superfine filter.

In order to optimise the oil separation, at least one further filter, preferably an active carbon filter, can be connected downstream of the superfine filter on the outlet side. The residual oil content may be reduced thereby to less than 0.005 mg/$m^3$.

The invention will be explained in more detail below with reference to a preferred exemplary embodiment in conjunction with the accompanying drawings.

DESCRIPTION OF THE PREFERRED EMBODIMENT

Figure 1:
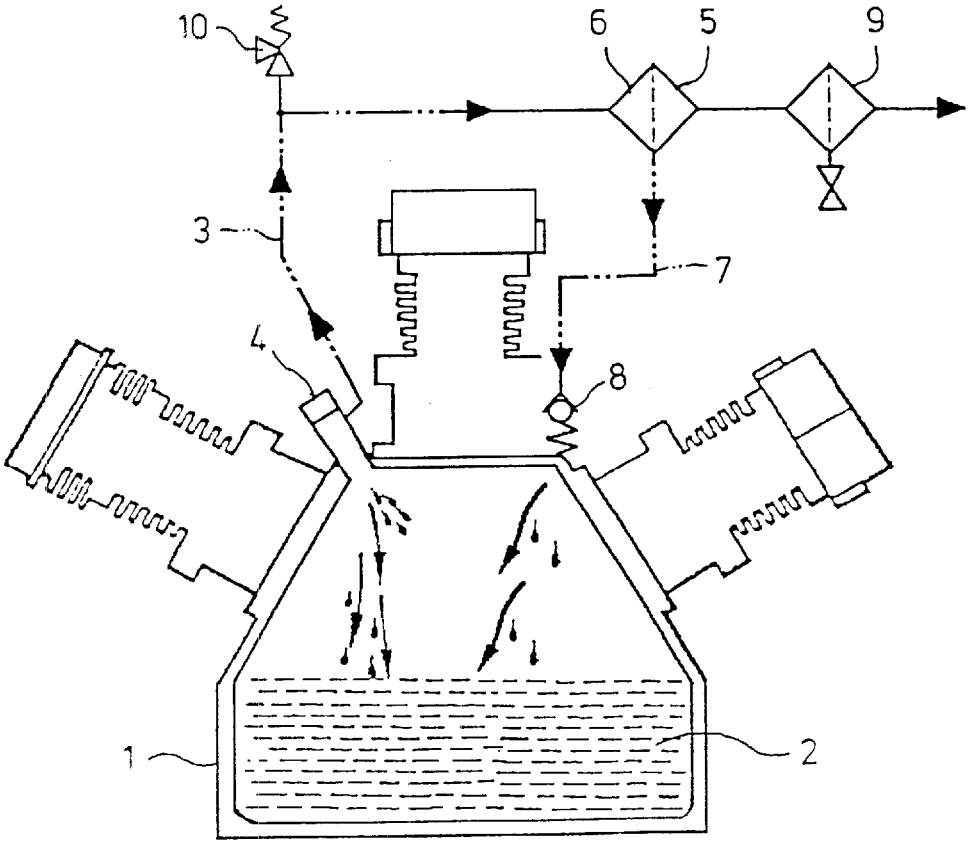
FIG. 1 is a schematic view of a secondary piston compressor with an associated venting device.

As shown in FIG. 1, the secondary compressor has a crankcase 1, which defines an oil sump 2. As a result of leakage. losses from the secondary compressor, a pressure builds up in the crankcase 1 which requires venting. For this purpose, a conduit 3 is connected to an oil filler pipe 4 of the crankcase 1. The oil filler pipe 4 represents an extremely low turbulence region of the crankcase. Accordingly, the mist discharged into the conduit 3 is not excessively heavily loaded with oil and oil vapours.

The conduit 3 leads to a superfine filter 5, which defines an oil collecting space 6 on the inlet side. The oil collecting space 6 is connected by means of a conduit 7 to the crankcase 1 with the interposition of a non-return valve 8, which is arranged in a vertical section of the conduit 7.

The superfine filter 5 has a filter element which comprises a microfibre fleece. The fine pored nature of the superfine filter permits the oil to be practically completely removed from the mist fed through the conduit 3. The area of the superfine filter can be so selected that the pressure loss is reduced to an amount which ensures a sufficient and reliable venting of the crankcase 1.

The oil dripping down from the superfine filter 5 collects in the oil collecting space 6. When the secondary compressor is running, the pressure in the crankcase 1 holds the non-return valve 8 closed with the aid of a light spring. If the secondary compressor is switched off, the pressure in the crankcase 1 dissipates via the conduit 3. The non-return valve opens under the action of the weight of its valve element and under the weight of the oil column in the conduit 7 and accumulated in the oil collecting space 6. The oil collecting space 6 thus empties into the crankcase 1.

Connected downstream of the superfine filter 5 is an active carbon filter 9, which communicates with the atmosphere. The residual oil content can be reduced in this manner to less than 0.005 $mg/m^3$.

If, during operation, trouble should occur in the superfine filter 5 or in the active carbon filter 9, a safety valve 10 ensures that an impermissible overpressure does not occur in the crankcase 1.

Modifications are of course possible within the scope of the invention. Thus the superfine filter need not necessarily be disposed directly above the secondary compressor. However, if a non-return valve is used in the conduit leading from the oil collecting space to the crankcase, this conduit must include an inclined section. The actual venting conduit need not necessarily be connected to the oil filler pipe. However, it should start from a region in which there is only low turbulence so that the vented mist thus contains as little oil as possible.

A basically different construction provides that the superfine filter is integrated into the crankcase. The superfine filter can then be limited not only to low turbulence regions by reason of its size. The wall of the oil collecting space then constitutes an effective shield for the superfine filter.

The expression "superfine filter" means a very fine filter which is defined by providing a residual oil content of less than about 0.01 $mg/m^3$ (which is equivalent to a residual dust content having a particle size of less than about 0.01 $\mu$m).

What is claimed is:

1. A piston compressor comprising:

a crankcase; and a superfine oil filter having an inlet side including an inlet connected to the crankcase for venting the crankcase, and a first outlet to vent the crankcase to the atmosphere, the inlet side of the superfine filter having an oil collecting space for containing oil separated in the superfine filter, the oil collecting space having a second outlet connected to the crankcase to deliver the oil from the oil collecting space to the crankcase when the compressor is not operating, the piston compressor being a secondary piston compressor for compressing precompressed gas.

2. A compressor as claimed in claim 1, wherein the superfine filter is arranged in a separate housing connected to the crankcase by means of conduits and wherein a conduit connecting the oil collecting space to the crankcase includes a valve which is adapted to adopt a closed position, when the compressor is operating, and an open position, when the compressor is not operating.

3. A compressor as claimed in claim 2, wherein the valve is arranged in an inclined section of the conduit connecting the oil collecting space to the crankcase and is constructed in the form of a non-return valve and wherein the valve is adapted to be held in its closed position by a pressure built up in the crankcase.

4. A compressor as claim 1, wherein a conduit, which, for the purpose of venting the crankcase, connects the crankcase to the inlet of the superfine filter, is connected to a low turbulence region of the crankcase.

5. A compressor as claimed in claim 4, wherein the conduit, which, for the purpose of venting the crankcase, connects the crankcase to the inlet of the superfine filter, is connected to an oil filler pipe of the crankcase.

6. A compressor as claimed in claim 1 further comprising a safety valve connected to a conduit which, for the purpose of venting the crankcase, connects the crankcase to the inlet of the superfine, the safety valve to prevent overpressure in the crankcase.

7. A compressor as claimed in claim 1, wherein connected downstream of the first outlet of the superfine filter there is at least one further filter.

8. A compressor as claimed in claim 7, wherein the further filter connected downstream of the superfine filter is an active carbon filter.

* * * * *

UNITED STATES PATENT AND TRADEMARK OFFICE

CERTIFICATE OF CORRECTION

PATENT NO. : 6,398,828 B1
DATED : June 4, 2002
INVENTOR(S) : Dannöhl

It is certified that error appears in the above-identified patent and that said Letters Patent is hereby corrected as shown below:

Column 4,
Line 34, after "as" please insert -- claimed in --.

Column 6,
Line 45, after "superfine" please insert -- filter --.

Signed and Sealed this

Eighth Day of February, 2005

JON W. DUDAS
*Director of the United States Patent and Trademark Office*